United States Patent [19]

Brown et al.

[11] 4,426,269

[45] Jan. 17, 1984

[54] METHOD OF STABILIZING ELECTRODES COATED WITH MIXED OXIDE ELECTROCATALYSTS DURING USE IN ELECTROCHEMICAL CELLS

[75] Inventors: David E. Brown, Weybridge; Mahmood N. Mahmood, Walton-on-Thames, both of England

[73] Assignee: The British Petroleum Company Limited, London, England

[21] Appl. No.: 170,668

[22] PCT Filed: Mar. 5, 1979

[86] PCT No.: PCT/GB79/00040

§ 371 Date: Oct. 22, 1979

§ 102(e) Date: Oct. 22, 1979

[87] PCT Pub. No.: WO79/00709

PCT Pub. Date: Sep. 20, 1979

[30] Foreign Application Priority Data

| | | | |
|---|---|---|---|
| Mar. 4, 1978 | [GB] | United Kingdom | 8663/78 |
| Jul. 19, 1978 | [GB] | United Kingdom | 30415/78 |
| Jul. 19, 1978 | [GB] | United Kingdom | 30415/78 |
| Sep. 6, 1978 | [GB] | United Kingdom | 35770/78 |

[51] Int. Cl.[3] ..... C25B 11/04

[52] U.S. Cl. ..... 204/242; 204/290 R

[58] Field of Search ..... 204/290 R, 290 F, 291, 204/242; 252/513, 519, 425.3, 470; 429/44

[56] References Cited

U.S. PATENT DOCUMENTS

| | | | |
|---|---|---|---|
| 3,336,209 | 8/1967 | Hirschberg | 204/128 |
| 3,364,072 | 1/1968 | Barber | 429/41 |
| 3,453,314 | 7/1969 | Lewna et al. | 252/470 X |
| 3,639,647 | 2/1972 | Kehl et al. | 252/439 |
| 3,691,100 | 9/1972 | Wright | 252/458 |
| 3,977,958 | 8/1976 | Caldwell et al. | 204/252 |
| 4,035,353 | 7/1977 | Kanetaka et al. | 252/470 X |
| 4,061,549 | 12/1977 | Hazelrigg et al. | 204/98 |
| 4,142,005 | 2/1979 | Caldwell et al. | 427/126 |

FOREIGN PATENT DOCUMENTS 1592294 6/1970 France .

OTHER PUBLICATIONS

Spaziante, Ing. Chem. Ital., vol. 11, No. 10, pp. 155–160, Oct. 1975.

Jaksic et al., Elektrkhimiya. vol. 13, No. 9, 1355–1360, Sep. 1977.

*Primary Examiner*—F. Edmundson

*Attorney, Agent, or Firm*—Brooks, Haidt, Haffner & Delahunty

[57] ABSTRACT

An electrochemical cell with an electrode having deposited thereon an electrocatalyst which is a mixed oxide of nickel-molydenum, nickel-tungsten, cobalt-molydenum or cobalt-tungsten and containing an aqueous alkaline electrolyte comprising an aqueous solution of a molybdenum, vanadium or tungsten compound. The electrodes are preferably prepared by alternately coating an electrode core with a compound of nickel or cobalt, and with a compound of molydenum or tungsten, said compounds being capable of thermal decomposition to the corresponding oxides, heating the coated core at an elevated temperature to form a layer of the mixed oxides on the core and finally curing the core with the mixed oxide layer thereon in a reducing atmosphere at a temperature between 350° C. and 600° C. The cells are particularly suitable for use in the electrolysis of water or brine.

9 Claims, No Drawings

METHOD OF STABILIZING ELECTRODES COATED WITH MIXED OXIDE ELECTROCATALYSTS DURING USE IN ELECTROCHEMICAL CELLS

The present invention relates to a method of stabilising the activity of electrodes coated with mixed oxide electrocatalysts during use in electrochemical cells.

An electrochemical cell is a device which has as basic components at least one anode and one cathode and an electrolyte. The cell may use electrical energy to carry out a chemical reaction such as the oxidation or reduction of a chemical compound as in an electrolytic cell. Alternatively, it can convert inherent chemical energy in a conventional fuel into low voltage direct current electrical energy as in a fuel cell. The electrodes, particularly the cathode, in such a cell may be of relatively inexpensive material such as massive iron. However, electrodes of such material tend to result in very low activity. These problems may be overcome to a degree by using electrodes activated with precious metals such as platinum. In such cases these precious metals are used as catalytic coatings on the surface of an elctrode core of inexpensive material. Such catalyst coatings are termed electrocatalysts. However, the use of precious metals in this manner results in high cost electrodes.

The above problems are particularly acute in electrochemical cells having a hydrogen electrode. Such electrochemical cells are used for several purposes, for example, the electrolysis of water to produce hydrogen and oxygen, in chlorine cells in which brine is electrolysed and in fuel cells which generate power by the oxidation of fuel. Of these processes, the electrolysis of water is used on an industrial scale for producing high purity hydrogen.

In the case of the production of hydrogen and oxygen by the electrolysis of water, water is decomposed into its elements when a current, eg a direct current, is passed between a pair of electrodes immersed in a suitable aqueous electrolyte. In order to obtain the gases evolved in a pure and safe condition, an ion-permeable membrane or diaphragm is placed between the electrodes to prevent the gases mixing. The basic elements of this cell are thus two electrodes, a diaphragm and a suitable electrolyte which is normally an alkaline electrolyte such as an aqueous solution of sodium hydroxide or potassium hydroxide due to their relatively low corrosivity.

In this case, the voltage, V, applied across the electrodes can be divided into three components, the decomposition voltage of water, $E_d$, the overvoltage at the electrodes, $E_o$, and the Ohmic loss in the inter-electrode gap which is the product of the cell current, I, and the electrical resistance (including the membrane resistance) of this gap, R.

Thus $V=E_d+E_o+IR$.

At 25° C. and at a pressure of one atmosphere, the reversible decomposition voltage of water is 1.23 volts. However, in practice cells operate at voltages of 1.8 to 2.2 volts, as a result inter alia of activation overvoltage.

Activation overvoltage results from the slowness of the reactions at the electrode surface and varies with the metal of the electrode and its surface condition. It may be reduced by operating at elevated temperatures and/or by using improved electrocatalysts but increases with the current density of the electrode reaction. The use of cathodes containing precious metal electrocatalysts such as platinum, for example, does achieve a reduction in activation overvoltage. However, the technical advantage to be obtained by the use of such precious metal electrocatalysts is substantially offset by the expense. The use of mixed cobalt/molybdenum oxide as electrocatalyst has also been suggested. Such an electrode, made by painting a nickel gauze with a mixed cobalt/molybdenum oxide electrocatalyst and polytetrafluorethylene (PTFE) followed by curing under hydrogen at or below 300° C. for 2 hours, initially had an electrode potential, versus a dynamic hydrogen electrode (DHE), of 142 mV at a current of 1000 mA/cm$^2$ and 70° C. The activity of this electrode decreased substantially when left immersed in solution on open circuit. The electrode potential rose to 260 mV versus DHE as a reference, at the same current density and temperature. This loss of activity and efficiency has hitherto prevented mixed cobalt/molybdenum oxide being used as an alternative to precious metal electrocatalysts.

Similar problems of loss of activity and stability are also encountered with anodes when they are coated with mixed oxide electrocatalysts.

It has now been found that the loss of activity of these alternative electrocatalysts can be substantially overcome by stabilising the electrodes containing these electrocatalysts by incorporating an additive into the electrolyte.

Accordingly the present invention is an electrochemical cell with an electrode having deposited thereon an electrocatalyst which is a mixed oxide of nickel-molybdenum, nickel-tungsten, cobalt-molybdenum or cobalt-tungsten and containing an aqueous alkaline electrolyte comprising an aqueous solution of a molybdenum, vanadium or tungsten compound.

The aqueous alkaline solution in the electrolyte suitably contains an alkali metal hydroxide in solution, preferably sodium hydroxide or potassium hydroxide. In water electrolysis aqueous solutions of potassium hydroxide are preferred due to their having greater conductivity than that of other hydroxides.

The molybdenum, vanadium or tungsten compound is suitably added to the electrolyte as an oxide. The chemical composition of the oxides of molybdenum, vanadium or tungsten in solution is uncertain and it is assumed that they exist as molybdate, vanadate or tungstate ions respectively. Thus, the molybdate, vanadate or tungstate ion may be introduced into the electrolyte solution by dissolving a compound of molybdenum, vanadium or tungsten, for example, molybdenum trioxide, vanadium pentoxide, tungsten trioxide, sodium molybdate, sodium vanadate, sodium tungstate, potassium molybdate, potassium vanadate, potassium tungstate or ammonium molybdate, ammonium vanadate or ammonium tungstate in aqueous solution. The concentration of the molybdenum, vanadium or tungsten compound in the electrolyte solution is suitably in the range of 0.005 and 5 grams per 100 ml of the electrolyte most preferably between 0.1 and 1 gram per 100 ml calculated as the trioxide for molybdenum and tungsten and as the pentoxide for vanadium.

One of the principal advantages of using an electrolyte containing a compound of molybdenum, vanadium or tungsten is that it stabilises electrodes coated with mixed oxide electrocatalysts.

The electrodes coated with the mixed oxide electrocatalysts and used in the present invention are preferably prepared by alternately coating an electrode core with a compound of nickel or cobalt, and with a compound of molybdenum or tungsten, said compounds being capable of thermal decomposition to the corresponding oxides, heating the coated core at an elevated temperature to form a layer of the mixed oxides on the core and finally curing the core with the mixed oxide layer thereon in a reducing atmosphere at a temperature between 350° C. and 600° C.

The core material on which the coating is carried out may be of a relatively inexpensive material such as nickel or massive iron. The material may be in the form of wire, tube, rod, planar or curved sheet, screen or gauze. A nickel screen is preferred.

In the preferred method of depositing the mixed oxide electrocatalyst the compound of nickel or cobalt is suitably a nitrate and the compound of molybdenum or tungsten is suitably a molybdate or tungstate, preferably ammonium paramolybdate or ammonium tungstate.

The coating may be applied onto the core by dipping the core in a solution of the compound or by spraying a solution of the compound on the core. The dipping may be carried out in the respective solutions of the compounds in any order and is preferably carried out several times. Thereafter the coated core is heated to decompose the compounds into the corresponding oxides. The heating is suitably carried out at a temperature between 400° and 1200° C., preferably between 700° and 900° C. This operation may be repeated several times until the core is completely covered by a layer of the mixed oxides.

The electrode core covered with a layer of the mixed oxides in this manner is then cured in an oven in a reducing atmosphere at a temperature between 350° C. and 600° C., preferably between 450° C. and 600° C. The reducing atmosphere is preferably pure hydrogen and the reduction is suitably carried out at atmospheric pressure.

After carrying out the above series of steps the electrode core suitably has an electrocatalyst loading of at least 10 mg/cm$^2$, preferably between 10 and 100 mg/cm$^2$ and most preferably between 40 and 100 mg/cm$^2$. The loading is the difference between the weight of the electrode core before deposition of the oxides and the weight thereof after deposition followed by curing in a reducing atmosphere.

The mixed oxide electrocatalysts used in the present invention may contain in addition to the two metal oxides a minor proportion of an alloy of the oxide forming metals which may be due to the reduction of the oxides during the curing step. Electrodes coated with such electrocatalysts can be installed as cathodes or anodes in electrochemical cells according to the present invention without substantial loss of activity of the electrode if left immersed on an open circuit during inoperative periods. The stabilisation of activity thus achieved enables cheaper electrocatalysts to be used instead of the more expensive platinum type electrocatalysts especially in commercial water electrolysers and chlorine cells, and thereby significantly improves the economic efficiency of these cells.

The invention is further illustrated with reference to the following Examples.

All electrochemical measurements in the following Examples were carried out as follows unless otherwise stated.

The activity of prepared electrodes was determined by measuring their potential against reference electrodes when a constant current was passed as indicated below. A three compartment cell was used for the measurements. Nickel screens were used as anodes and either a Dynamic Hydrogen Electrode (DHE) or a Saturated Calomel Electrode (SCE) were used as the reference electrode.

The electrolyte was 30% w/v potassium hydroxide (approx 5 N); all experiments were conducted at 70° C. unless otherwise stated.

All electrode potentials were IR corrected using the interrupter technique and are quoted with respect to the DHE. Electrode potentials are reproducible to ±10 mV. The potential of the DHE with respect to the normal hydrogen electrode under the conditions specified above is −60 mV.

EXAMPLE 1

In a cell for the electrolysis of water using an electrode made by painting nickel gauze of 120 mesh with a mixed cobalt/molybdenum oxide electrocatalyst and PTFE and curing under hydrogen at 300° C. for 2 hours the following results were obtained on operating the cell at 70° C.:

TABLE 1

| Current | Electrode potential vs DHE |
|---|---|
| 200 mA/cm$^2$ | 50 mV |
| 1,000 mA/cm$^2$ | 142 mV |
| 2,000 mA/cm$^2$ | 190–200 mV |

When the electrode was left immersed in the electrolyte (5 N KOH) on open circuit overnight, ie with no current passing through the cell, the activity of the electrode decreased substantially. At a current of 1,000 mA/cm$^2$ the electrode potential was over 260 mV vs a dynamic hydrogen electrode as a reference.

Addition of 1 g of $MoO_3$ per 100 ml of the electrolyte (5 N KOH), restored the activity of the electrode to the original value shown in Table 1.

The electrode was then left immersed in the electrolyte containing $MoO_3$ on open circuit for three days after which performance was unchanged. In another experiment the electrode was tested for a total of 30 hours passing a current density of 2 A/cm$^2$ for 6 hours a day and no appreciable loss of performance occurred.

EXAMPLE 2

(i) Preparation of Electrodes

A clean weighed nickel screen (1 cm×1 cm) was dipped alternatively in separate solutions of 2 molar nickel nitrate and a 0.08 molar ammonium paramolybdate. After every dipping the screen was heated in a blue bunsen flame to red heat (700°–900° C.) The operation was repeated several times until the screen was completely covered by a layer of mixed oxides. The electrode was then heated in an oven under an atmosphere of hydrogen at a range of temperatures. Finally the activity of the electrodes was measured as described above.

(ii) Results on Activity and Stability in Water Electrolysis

(a) Temperature of Heat Treatment in the Oven

Electrodes cured under an atmosphere of hydrogen in an oven at various temperatures were prepared as in (i) above and tested as cathodes using an alkaline electrolyte. Table 2 summarises the results obtained. Results in Table 2 show that the best temperature ranges for the hydrogen treatment is 350°–600° C.

(b) Catalyst Loading

Electrodes with various catalyst loadings were prepared as in (i) above and their cathodic activity testing using an alkaline electrolyte. Table 3 shows the results obtained. From the results in Table 3 it is concluded that the catalyst loading should be more than 10 mg/cm$^2$, and for best results, the loading should be more than 40 mg/cm$^2$. Table 3 shows that electrode activity continues to improve with higher catalyst loading.

(c) Stability of Electrodes

When molybdenum trioxide or vanadium pentoxide was added to the alkaline electrolyte before electrolysis it was found that the electrodes do not lose their activity if left standing on open circuit. The electrodes were tested at 1 A/cm$^2$ for many hours over a period of days. The results obtained are shown in Table 4.

TABLE 2

EFFECT OF HEAT TREATMENT ON THE ACTIVITY OF THE NiMo OXIDE CATHODES

| | | |
|---|---|---|
| Electrolyte | = | 5N KOH |
| Temperature | = | 70° C. |
| Current density | = | 1A/cm$^2$ |
| Catalyst loading | = | 40 mg/cm$^2$ |

| Electrode No | Temperature of Oven °C. | Electrode Potential vs DHE mV |
|---|---|---|
| 1 | 300 | −140 |
| 2 | 350–370 | −31 |
| 3 | 400 | −35 |
| 4 | 460 | −35 |
| 5 | 500 | −40 |
| 6 | 600 | −32 |
| 7 | 700 | −210 |

TABLE 3

EFFECT OF NiMo OXIDE CATALYST LOADING ON CATHODE ACTIVITY

| | | |
|---|---|---|
| Electrolyte | = | 5N KOH |
| Current density | = | 1A/cm$^2$ |
| Temperature of electrolysis | = | 80° C. |
| Curing temperature | = | 500° C. |

| Electrode No | Catalyst Loading mg/cm$^2$ | Electrode Potential vs DHE mV |
|---|---|---|
| 1 | 7.6 | −210 |
| 2 | 9.4 | −145 |
| 3 | 12.5 | −50 |
| 4 | 17.5 | −44 to 50 |
| 5 | 29 | −44 to −50 |
| 6 | 33 | −45 |

TABLE 3-continued

EFFECT OF NiMo OXIDE CATALYST LOADING ON CATHODE ACTIVITY

| | | |
|---|---|---|
| Electrolyte | = | 5N KOH |
| Current density | = | 1A/cm$^2$ |
| Temperature of electrolysis | = | 80° C. |
| Curing temperature | = | 500° C. |

| Electrode No | Catalyst Loading mg/cm$^2$ | Electrode Potential vs DHE mV |
|---|---|---|
| 7 | 40 | −22 |
| 8 | 50 | −20 |
| 9 | 67 | −17 |

TABLE 4

LONG-TERM TEST ON Ni/Mo OXIDE ELECTRODES
Current = 1A/cm$^2$

| Electrode No | Curing Temperature °C. | Temperature of Electrolysis | Amp Hrs | Duration of Experiment (days) | % Additive | Initial Electrode Potential mV | Final Electrode Potential mV |
|---|---|---|---|---|---|---|---|
| 1 | 460 | 80 | 110 | 13 | 0.5% $MoO_3$ | −25 | −35 |
| 2 | 460 | 80 | 90 | 13 | None | −30 | −120 |
| 3 | 500 | 70 | 30 | 7 | None | −50 | −120 |
| 4 | 500 | 70 | 30 | 5 | 0.5% $MoO_3$ | −30 | −45 |
| 5 | 600 | 70 | 230 | 9 | 0.25% $MoO_3$ | −60 | −80 |
| 6 | 400 | 70 | 70 | 16 | 0.5% $V_2O_5$ | −40 | −50 |

EXAMPLE 3

Electrolysis of Brine

Mixed nickel-molybdenum oxide electrodes were prepared from a 3.4 molar solution of nickel nitrate and a 0.143 molar solution of ammonium molybdate as described in Example 2 above. The electrodes were heated at 400° C. under hydrogen for one hour. The electrode activities were determined in two solutions:

(i) Solution A: a solution containing 12% w/v sodium hydroxide and 15% w/v sodium chloride.

(ii) Solution B: a solution containing 12% w/v sodium hydroxide 15% w/v sodium chloride and 0.5% w/v vanadium pentoxide.

Each solution was alternately electrolysed at 1 amp. cm$^{-2}$ for a selected period and then left on open circuit at 70° C. The activity of the electrode was determined after each operation. After the period on open circuit, the solution was electrolysed for five minutes at 1 amp cm$^{-2}$. The activity of the electrode was then determined by the method described above with reference to a saturated calomel electrode at 70° C. For consistency, the results are quoted with respect to a DHE in 30% w/v KOH solution at 70° C.

TABLE 5

| | SOLUTION A Electrode catalyst load = 33 mg/cm$^2$ | SOLUTION B Electrode catalyst load = 42 mg/cm$^2$ |
|---|---|---|
| Electrode potential (mV) after electrolysis for 1 hour | +30 | +8 |
| Electrode potential (mV) after an 18 hour period on open circuit | −61 | +6 |

The results in Table 5 show that the activity of mixed nickel-molybdenum oxide electrodes is stabilised by addition of vanadium pentoxide.

EXAMPLE 4

Water Electrolysis

Mixed nickel-tungsten oxide electrodes were prepared from a 0.45 molar solution of nickel nitrate and a 0.075 molar solution of metatungstic acid by the alternate dipping technique described in Example 2 above. They were heated at 500° C. under hydrogen for 1 hour. The electrode activity was determined in a solution of 30% w/v potassium hydroxide (Solution C), and in a solution of 30% w/v potassium hydroxide containing 0.5% w/v vanadium pentoxide (Solution D) by the method described above. Each solution was alternately electrolysed for a selected period and then left on open circuit at 70° C. The activity of the electrode was determined after each operation. The results are quoted below with respect to a DHE.

TABLE 6

| | SOLUTION C Electrode catalyst load = 64 mg/cm$^2$ | SOLUTION D Electrode catalyst load = 48 mg/cm$^2$ |
|---|---|---|
| Electrode potential (mV) after electrolysis for 2½ hours | −77 | −81 |
| Electrode potential (mV) after an 18 hour period on open circuit | −176 | −89 |

The results in Table 6 show that the activity of mixed nickel tungsten oxide electrodes is stabilised by addition of vanadium pentoxide to the electrolyte.

EXAMPLE 5

Water Electrolysis

Mixed cobalt-tungsten oxide electrodes were prepared from a 0.75 molar solution of cobalt nitrate and a 0.125 molar solution of metatungstic acid containing 7% w/v ammonia and 6% w/v potassium hydroxide by the alternate dipping technique described in Example 2. They were heated at 500° C. under hydrogen for 1 hour. The electrode activity was determined in a solution of 30% w/v potassium hydroxide (Solution E), and in a solution of 30% w/v potassium hydroxide containing 0.5% w/v of tungsten oxide (Solution F) by the method described above. Each solution was alternately electrolysed for a selected period and then left on open circuit at 70° C. The activity of the electrode was determined after each operation. The results are quoted below with respect to a DHE.

TABLE 7

| | SOLUTION E Electrode catalyst load = 82 mg/cm$^2$ | SOLUTION F Electrode catalyst load = 75 mg/cm$^2$ |
|---|---|---|
| Electrode potential (mV) after electrolysis for 3½ hours | −24 | −30 |
| Electrode potential (mV) after a 3½ hour period on open circuit | −70 | −50 |
| Electrode potential (mV) after a 17½ hour period on open circuit | −90 | −54 |

We claim:

1. An electrochemical cell comprising: (i) an electrode having an electrocatalyst composition on a surface of the electrode, said electrocatalyst comprising a mixed oxide of nickel-molybdenum, nickel-tungsten, cobalt-molybdenum or cobalt-tungsten, and (ii) an electrolyte composition comprising an alkaline aqueous solution of a molybdenum, vanadium or tungsten compound.

2. An electrochemical cell according to claim 1 wherein the electrolyte contains an alkali metal hydroxide in solution.

3. An electrochemical cell according to claim 1 wherein the molybdenum, vanadium or tungsten compound is added to the electrolyte as an oxide.

4. An electrochemical cell according to claim 3 wherein the molybdenum, vanadium or tungsten oxide is present in the electrolyte as a molybdate, vanadate or tungstate ion respectively.

5. An electrochemical cell according to claim 1 wherein the concentration of molybdenum, vanadium or tungsten compound in the electrolyte is between 0.005 and 5 grams per 100 ml of the electrolyte.

6. An electrochemical cell according to claim 1 wherein the electrode having the mixed oxide electrocatalyst thereon is prepared by alternately coating an electrode core with a compound of nickel or cobalt and with a compound of molybdenum or tungsten, said compounds being capable of thermal decomposition to the corresponding oxides, heating the coated core at an elevated temperature to form a layer of the mixed oxides on the core and finally curing the core with the mixed oxide layer thereon in a reducing atmosphere at a temperature between 350° C. and 600° C.

7. An electrochemical cell according to claim 6 wherein the electrode core covered with a layer of mixed oxides is cured between 450° C. and 600° C.

8. An electrochemical cell according to claim 6 wherein the curing is carried out in an atmosphere of pure hydrogen at atmospheric pressure.

9. An electrochemical cell according to claim 1 wherein the electrode has an electrocatalyst loading of between 10 and 100 mg/cm$^2$.

* * * * *